US008547370B2

(12) United States Patent
Hong et al.

(10) Patent No.: US 8,547,370 B2
(45) Date of Patent: Oct. 1, 2013

(54) LCD VOLTAGE GENERATING CIRCUITS

(75) Inventors: Sung-Hwan Hong, Suwon-si (KR); Nam-Seok Lee, Suwon-si (KR); Sung-Kyu Hong, Seongnam-si (KR); Ho-Yun Byun, Hwaseong-si (KR)

(73) Assignee: Samsung Display Co., Ltd. (KR)

( * ) Notice: Subject to any disclaimer, the term of this patent is extended or adjusted under 35 U.S.C. 154(b) by 1175 days.

(21) Appl. No.: 11/891,528

(22) Filed: Aug. 10, 2007

(65) Prior Publication Data

US 2008/0062100 A1 Mar. 13, 2008

(30) Foreign Application Priority Data

Sep. 13, 2006 (KR) ..... 2006-88712

(51) Int. Cl.
*G09G 3/36* (2006.01)

(52) U.S. Cl.
USPC ..... 345/211; 345/101

(58) Field of Classification Search
USPC ..... 345/87–104, 211
See application file for complete search history.

(56) References Cited

U.S. PATENT DOCUMENTS

| | | | | |
|---|---|---|---|---|
| 7,825,889 | B2 * | 11/2010 | Kim et al. | 345/101 |
| 2002/0097214 | A1 * | 7/2002 | Song | 345/96 |
| 2003/0164813 | A1 * | 9/2003 | Fujii | 345/101 |
| 2005/0184946 | A1 * | 8/2005 | Pyoun et al. | 345/94 |
| 2005/0207249 | A1 * | 9/2005 | Morita | 365/203 |
| 2005/0253832 | A1 * | 11/2005 | Chung | 345/204 |
| 2006/0164354 | A1 * | 7/2006 | Lee et al. | 345/89 |

FOREIGN PATENT DOCUMENTS

| | | |
|---|---|---|
| JP | 2000-089192 | 3/2000 |
| JP | 2006-030616 | 2/2006 |
| KR | 10-2001-0004902 | 1/2001 |

* cited by examiner

*Primary Examiner* — Allison Walthall

(74) *Attorney, Agent, or Firm* — Innovation Counsel LLP

(57) ABSTRACT

In a voltage generating circuit and a display apparatus, a driving voltage generator receives an input voltage to output a first driving voltage and a second driving voltage that is inversely proportional to a temperature in response to a feedback voltage. A temperature compensator generates the feedback voltage as a function of the temperature and the second driving voltage and applies it to the driving voltage generator. A gate-on voltage generator pumps the second driving voltage to generate a gate-on voltage, and a gamma voltage generator outputs a plurality of gamma voltages, each having a different voltage level that is disposed between the first driving voltage and a ground voltage. The gate-on voltage, which is inversely proportional to the temperature, is applied to the gate driver, and the gamma voltages, which are maintained at constant levels, prevent the response speed of the display apparatus from varying with temperature.

14 Claims, 6 Drawing Sheets

LCD VOLTAGE GENERATING CIRCUITS

RELATED APPLICATIONS

This application claims priority of Korean Patent Application No. 2006-88712, filed Sep. 13, 2006, the entire disclosure of which is incorporated herein by reference.

BACKGROUND

This invention relates to voltage generating circuits for liquid crystal displays (LCDs) in general, and in particular, to voltage generating circuits that prevent unstable operation of LCDs due to variations in display temperature.

LCDs include a LCD panel that comprises a lower substrate, an upper substrate facing the lower substrate, and a layer of a liquid crystal material interposed between the lower and upper substrates to display an image. The LCD panel is provided with respective pluralities of gate lines, data lines and pixels that are connected to the gate lines and the data lines.

The LCD panels include a gate driving circuit sequentially outputting gate pulses to the gate lines and a data driving circuit outputting pixel voltages to respective ones of the data lines. Each of the gate and data driving circuits is packaged in the form of a chip that mounts on a film or directly on the LCD panel.

Recently, in order to reduce the number of the gate and data driving chips, LCDs have begun to employ a gate-IC-less (GIL) structure in which the gate driving circuit is formed directly on the lower substrate through a thin film process. In GIL type LCDs, the gate driving circuit includes a shift register having a plurality of stages connected to each other in sequential fashion. Each stage is connected to a corresponding one of the gate lines and outputs the gate pulse thereto.

GIL type LCDs have a display characteristic that makes the screen of the display go white when the display is operated at a display temperature that is lower than a normal display operating temperature, and makes the screen go black when the display is operated at a display temperature that is higher than the normal display operating temperature. This is caused by a temperature characteristic of the thin film transistors of the gate driving circuit. That is, the operation of the thin film transistors is hypoactive at low display temperatures and hyperactive at high display temperatures. As a result, operation of the gate driving circuit is unstable because of a variation in the temperature of the display, which in turn, results in a deterioration of the display quality of the LCD.

BRIEF SUMMARY

In accordance with the exemplary embodiments described herein, voltage generating circuits are provided that prevent a variation in the response speed of LCD panels due to variation in display temperature, as well as LCDs incorporating such voltage generating circuits.

In one exemplary embodiment, a voltage generating circuit includes a driving voltage generator, a temperature compensator, a gate-on voltage generator and a gamma voltage generator.

The driving voltage generator changes an external input voltage into a first driving voltage and outputs the first driving voltage and a second driving voltage that is varied in accordance with display temperature in response to a feedback voltage. The temperature compensator receives the second driving voltage, generates the feedback voltage as a function of the temperature and the second driving voltage and applies the feedback voltage to the driving voltage generator. The gate-on voltage generator pumps the second driving voltage to generate a gate-on voltage. The gamma voltage generator receives the first driving voltage and generates a plurality of gamma voltages therefrom, each gamma voltage having a different voltage level that is disposed between the first driving voltage and a ground voltage.

In another exemplary embodiment, an LCD includes a driving voltage generator, a temperature compensator, a gate-on voltage generator, a gate-off voltage generator, a gamma voltage generator, a gate driver, a data driver and a display panel.

The driving voltage generator changes an external input voltage into a first driving voltage and outputs the first driving voltage and a second driving voltage that is varied in accordance with a temperature in response to a feedback voltage. The temperature compensator receives the second driving voltage, generates the feedback voltage as a function of the temperature and the second driving voltage, and applies the feedback voltage to the driving voltage generator. The gate-on voltage generator pumps the second driving voltage to generate a gate-on voltage. The gate-off voltage generator receives the first driving voltage and lowers the first driving voltage to a gate-off voltage. The gamma voltage generator receives the first driving voltage and generates a plurality of gamma voltages therefrom, each gamma voltage having a different voltage level that is disposed between the first driving voltage and a ground voltage. The gate driver sequentially outputs a gate pulse in response to the gate-on voltage and the gate-off voltage. The data driver changes an image signal into a pixel voltage based on the gamma voltages and outputs the pixel voltage. The display panel charges the pixel voltage in a pixel in response to the gate pulse so as to display an image.

In accordance with the exemplary embodiments hereof, the gate-on voltage, which is inversely proportional to the temperature, is applied to the gate driver, so that the gate driver operates stably, and the gamma voltages are maintained at constant levels independently of the temperature, thereby preventing variation of the response speed of the display apparatus due to the ambient temperature.

A better understanding of the above and many other features and advantages of the LCD voltage generating circuits of the present invention may be obtained from a consideration of the detailed description below of some exemplary embodiments thereof, particularly if such consideration is made in conjunction with the appended drawings, wherein like reference numerals are used to identify like elements illustrated in one or more of the figures thereof.

DETAILED DESCRIPTION

Exemplary embodiments of the present invention are described in detail below with reference to the accompanying drawings, in which the thickness of layers, films, and regions are exaggerated for clarity. Like numerals are used to refer to like elements throughout. Also, it should be understood that when a first element, such as a layer, film, region, or substrate, is described as being disposed "on" a second element, this can mean that the first element is disposed directly on the second element, or alternatively, that one or more other elements may be interposed between the first and second elements.

Figure 1:
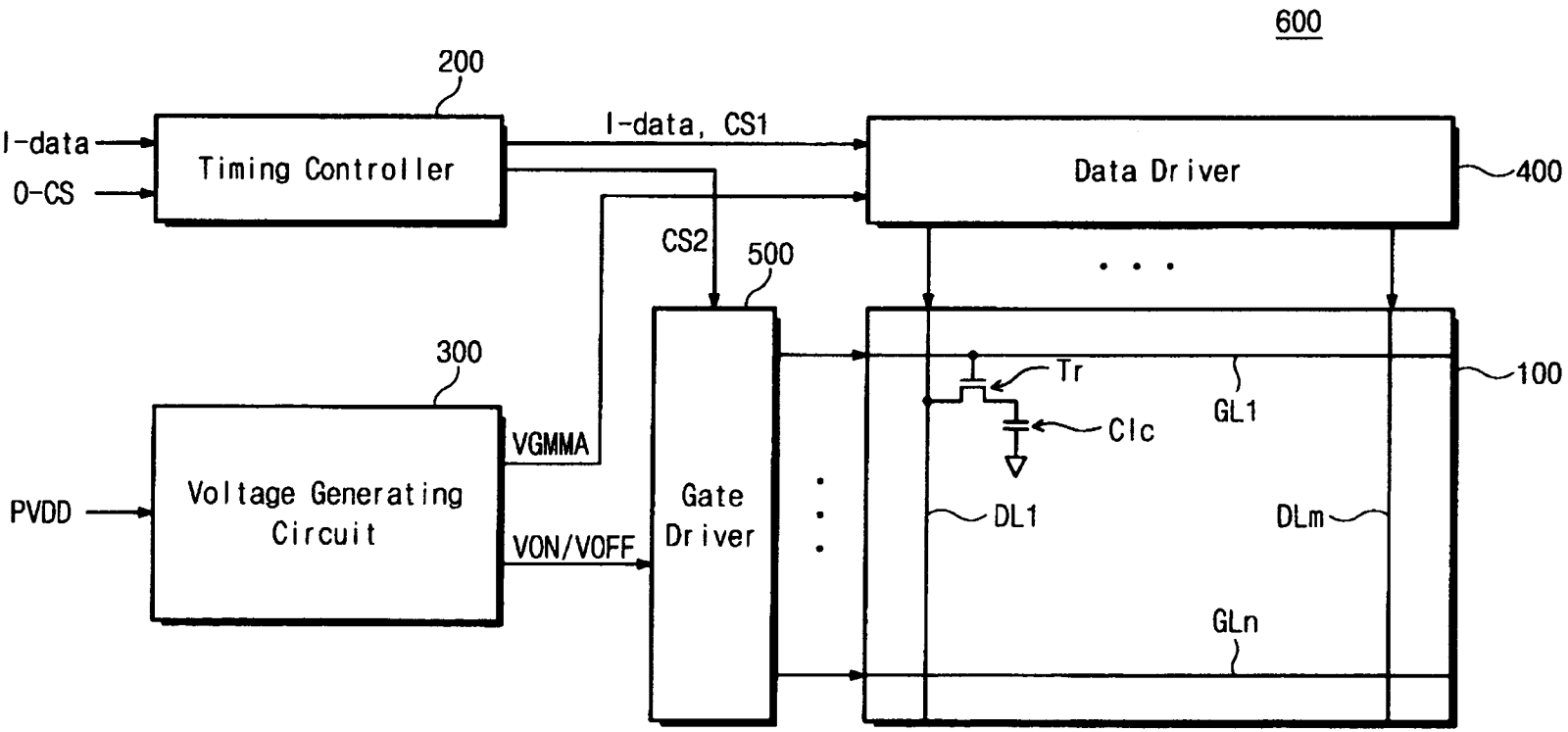
FIG. 1 is a functional block diagram of an exemplary embodiment of an LCD in accordance with the present invention.

FIG. 1 is a functional block diagram of an exemplary embodiment of an LCD in accordance with the present invention. In FIG. 1, the exemplary LCD 600 includes a display panel 100, a timing controller 200, a voltage generating circuit 300, a data driver 400 and a gate driver 500.

The display panel 100 includes a plurality of gate lines GL1-GLn, a plurality of data lines DL1-DLm insulated from and intersecting the gate lines GL1-GLn, and a plurality of pixels. The pixels are arranged in pixel regions defined by the gate and data lines GL1-GLn and DL1-DLm in a matrix configuration. Each of the pixels includes a thin film transistor Tr and a liquid crystal capacitor Clc.

In an exemplary first pixel of the LCD of FIG. 1, the thin film transistor Tr thereof includes a control electrode electrically connected to a first gate line GL1, an input electrode electrically connected to a first data line DL1, and an output electrode electrically connected to a first pixel electrode that also serves as a first electrode of the first liquid crystal capacitor Clc. A common electrode facing the pixel electrode, and to which a common voltage is applied, serves as the second electrode of the liquid crystal capacitor Clc.

The timing controller 200 receives an image signal I-data and various control signals O-CS from an external graphic controller (not illustrated). The timing controller 200 receives the various control signals O-CS, for example, a vertical synchronization signal, a horizontal synchronization signal, a main clock, a data enable signal, and outputs the image signal I-data and first and second timing control signals CS1 and CS2. The image signal I-data is applied to the data driver 400 in synchronization with the first timing control signal CS1, and the second timing control signal CS2 is applied to the gate driver 500.

The first timing control signal CS1 serves as a control signal that controls the operation of the data driver 400, and includes a horizontal start signal, an inversion signal and an output indication signal. The second timing control signal CS2 serves as a control signal that controls the operation of the gate driver 500, and includes a vertical start signal, a gate clock signal and an output enable signal.

The voltage generating circuit 300 generates voltages, such as a gamma voltage VGMMA, a gate-on voltage VON, and a gate-off voltage VOFF, using an input voltage PVDD from an external source, which are used in the LCD 600. The gamma voltage VGMMA generated by the voltage generating circuit 300 is applied to the data driver 400 and used as a reference voltage when the image signal I-data is converted into a pixel voltage having a gray-scale correspondence. The gate-on voltage VON and the gate-off voltage VOFF generated by the voltage generating circuit 300 are applied to the gate driver 500 and used to generate the gate pulses.

The data driver 400 receives the image signal I-data in synchronization with the first timing control signal CS1 and receives the gamma voltage VGMMA from the voltage circuit 300. The data driver 400 converts the image signal I-data into the pixel voltage having a gray-scale corresponding to the digital value of the image signal I-data based on the gamma voltage VGMMA. The data driver 400 is electrically connected to the data lines DL1-DLm arranged on the display panel 100. Thus, the pixel voltage output from the data driver 400 is applied to the data lines DL1-DLm.

The gate driver 500 receives the gate-on voltage VON and the gate-off voltage VOFF from the voltage generating circuit 300 and sequentially outputs the gate pulse in response to the second timing control signal CS2. The gate driver 500 is electrically connected to the gate lines GL1-GLn of the display panel 100. Thus, the gate pulse output from the gate driver 500 is sequentially applied to each of the gate lines GL1-GLn.

In each pixel of the display panel 100, the thin film transistor Tr is turned on in response to the gate pulse applied through a corresponding one of the gate lines GL1-GLn in order to output the pixel voltage applied through a corresponding one of the data lines DL1-DLm. A voltage difference between the pixel voltage and the common voltage is charged into the liquid crystal capacitor Clc, and an electric field is formed between the pixel electrode and the common electrode, so that that the molecules of the liquid crystal layer disposed between the two electrodes are aligned in a predetermined direction due to the electric field. The transmittance of light that is incident into the liquid crystal panel 100 is controlled in accordance with the alignment of the liquid crystal molecules, thereby displaying an image formed by the light on the liquid crystal panel 100.

Figure 2:
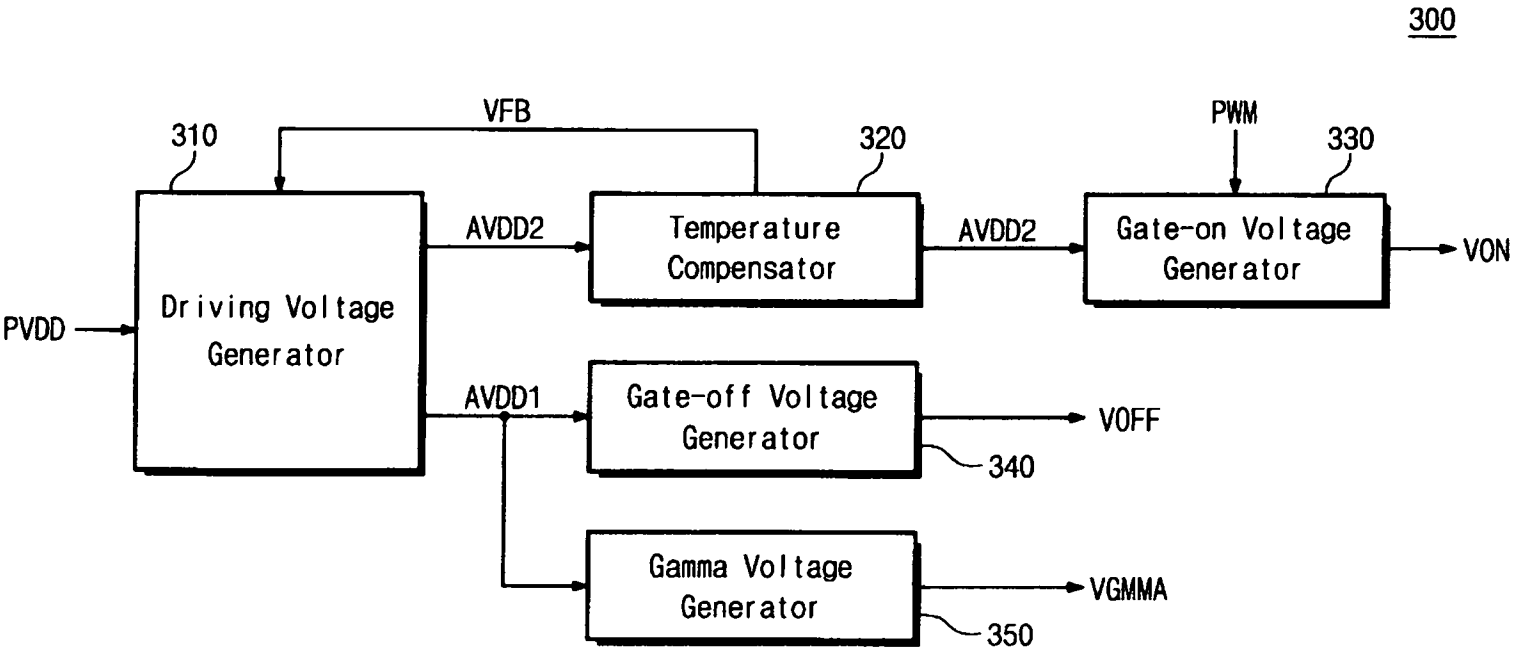
FIG. 2 is a functional block diagram of an exemplary embodiment of a voltage generating circuit of the exemplary LCD of FIG. 1.
Figure 3:
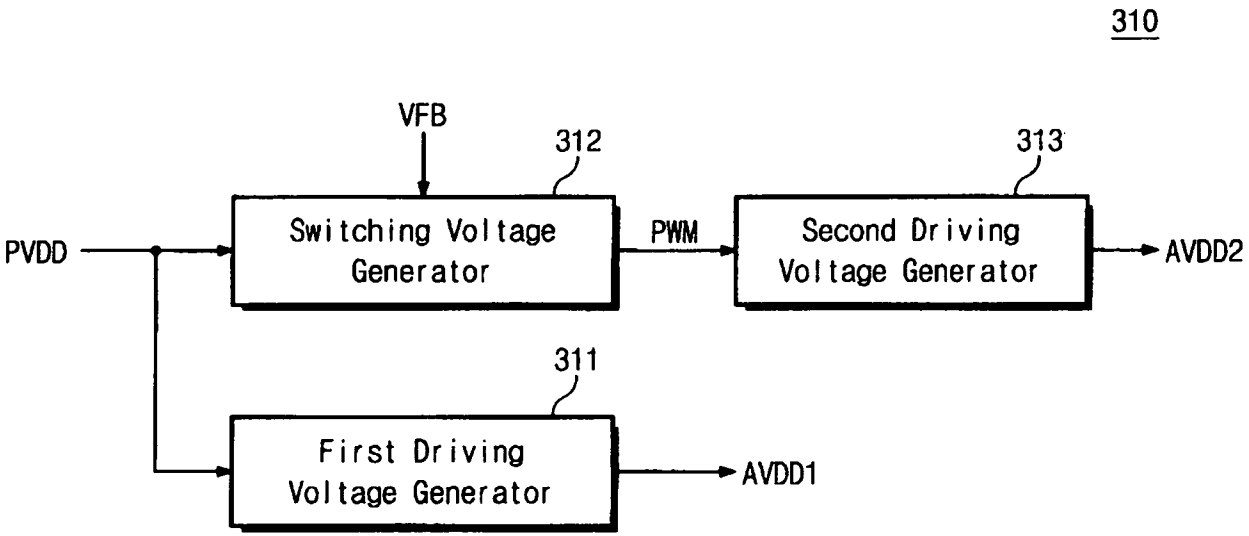
FIG. 3 is a functional block diagram of an exemplary embodiment of a driving voltage generator of the exemplary voltage generating circuit of FIG. 2.

FIG. 2 is a functional block diagram of an exemplary embodiment of a voltage generating circuit of the exemplary LCD of FIG. 1, and FIG. 3 is a functional block diagram of an exemplary embodiment of a driving voltage generator of the exemplary voltage generating circuit of FIG. 2.

Referring to FIGS. 2 and 3, the voltage generating circuit 300 includes a driving voltage generator 310, a temperature compensator 320, a gate-on voltage generator 330, a gate-off voltage generator 340, and a gamma voltage generator 350.

In FIG. 3, the driving voltage generator 310 includes a first driving voltage generator 311, a switching voltage generator 312 and a second driving voltage generator 313. The first driving voltage generator 311 converts the input voltage PVDD into a first driving voltage AVDD1 and outputs the first driving voltage AVDD1.

The switching voltage generator 312 boosts the input voltage PVDD a predetermined number of times in order to generate a switching pulse voltage PWM that swings between 0 volts and the boosted voltage level. For example, when an input voltage PVDD of about 3.3 volts is applied to a switching voltage generator 312 having a boosting capability of about three times, a switching pulse voltage PWM that swings between 0 volt and 10 volts is generated by the switching voltage generator 312. The switching voltage generator 312 also receives a feedback voltage VFB that is fed back from the temperature compensator 320 and controls the amplitude of the switching pulse voltage PWM in accordance with the feedback voltage VFB.

The second driving voltage generator 313 receives the switching pulse voltage PWM from the switching voltage generator 312 and rectifies the switching pulse voltage PWM to generate a second driving voltage AVDD2. Thus, the second driving voltage AVDD2 has a voltage level that is varied in accordance with the feedback voltage VFB from the temperature compensator 320.

Accordingly, the driving voltage generator 310 outputs both a first driving voltage AVDD1 that is maintained at a constant voltage level despite any variation in display temperature, and a second driving voltage AVDD2 that varies in accordance with the display temperature.

In FIG. 2, the temperature compensator 320 receives the second driving voltage AVDD2 from the driving voltage generator 310, as well as a sensing voltage indicating a variation in temperature from a temperature sensor (not illustrated). The temperature compensator 320 compares the second driving voltage AVDD2 with a predetermined reference voltage corresponding to a temperature indicated by the sensing voltage and compensates the voltage level of the second driving voltage AVDD2 based on the result of the comparison to generate the feedback voltage VFB. In particular, the feedback voltage VFB is proportional to the temperature. Thus, the voltage level of the feedback voltage VFB from the temperature compensator 320 increases when the temperature is high and decreases when the temperature is low.

As illustrated in FIGS. 2 and 3, the feedback voltage VFB is applied to the switching voltage generator 312 of the driving voltage generator 310. In operation, when the display temperature is high, the switching voltage generator 312 generates a switching pulse voltage PWM having an amplitude that is reduced in response to a feedback voltage VFB having a higher voltage level, and generates a switching pulse voltage PWM having an amplitude that is increased in response to a feedback voltage VFB having a lower voltage level.

Consequently, the driving voltage generator 310 outputs a second driving voltage AVDD2 that is inversely proportional to the variation in display temperature, and the second driving voltage AVDD2 is applied to the gate-on voltage generator 330.

The gate-on voltage generator 330 generates the gate-on voltage VON using the second driving voltage AVDD2 and the switching pulse voltage PWM. The gate-on voltage generator 330 includes a charge pump circuit to generate a gate-on voltage VON that is larger than the second driving voltage AVDD2 by a multiple of two or three times the switching pulse voltage PWM. Thus, the gate-on voltage VON output from the gate-on voltage generator 330 decreases when the display temperature increases and increases when the display temperature decreases. That is, the gate-on voltage VON is inversely proportional to the display temperature.

Figure 8:
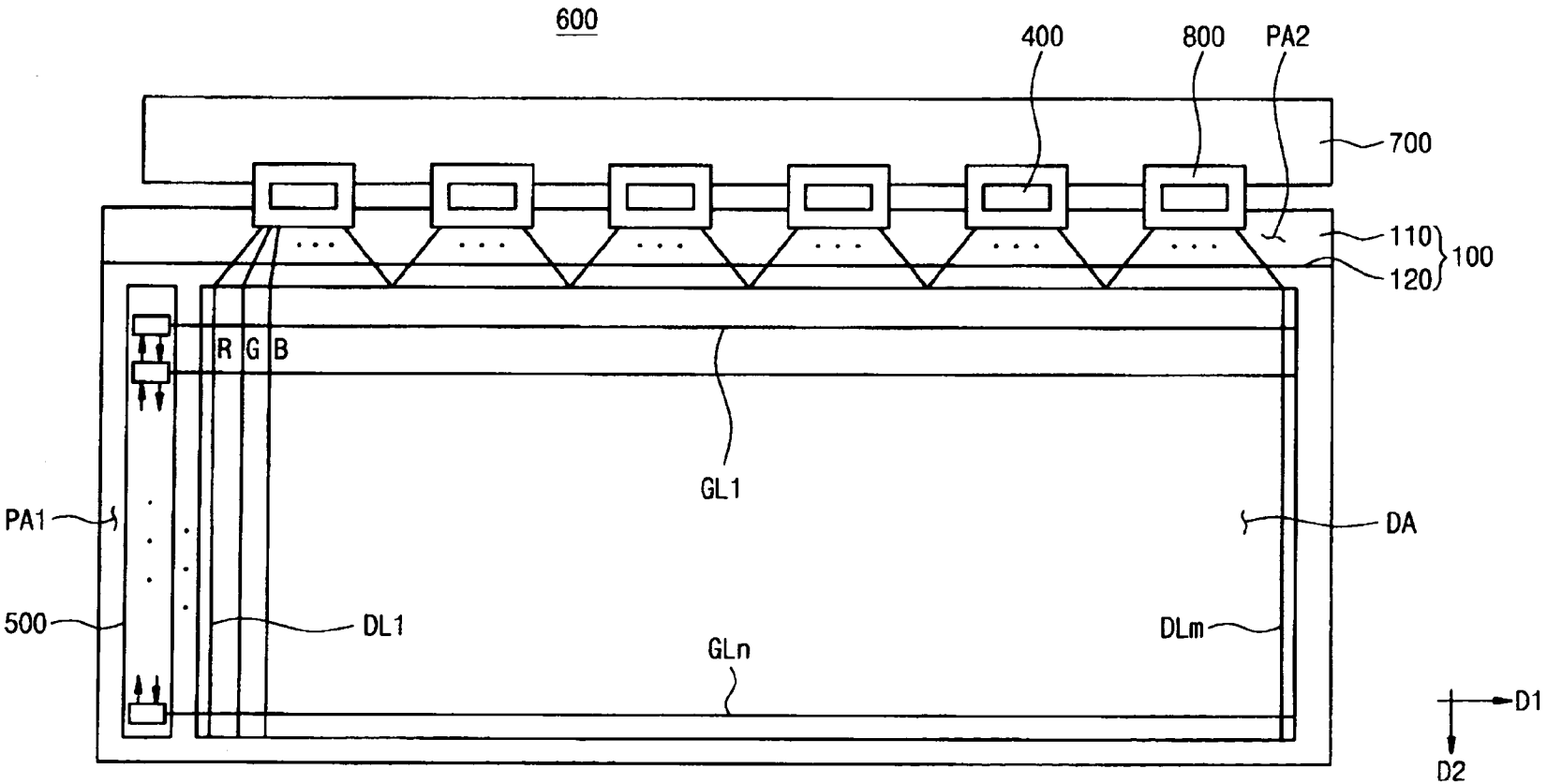

In the exemplary embodiment of FIGS. 1 and 8, the gate driver 500 is formed directly on the display panel 100. More specifically, the gate driver 500 is formed directly on the display panel 100 through the same thin film process that is used to form the pixels on the display panel 100. In this embodiment, the gate driver 500 includes a shift register in which plural stages are connected to each other one after the other, and in which each of the stages includes a plurality of interconnected thin film transistors. As those of skill in the art will appreciate, when the operating characteristics of an output transistor of each stage varies in accordance with a variation in display temperature, the display quality of the display panel 100 may deteriorate as a result.

However, when the gate-on voltage VON applied to the output transistor is varied in accordance with such temperature variation, the gate driver 500 will operate stably, even though the display temperature varies. For instance, since the output transistors are hypoactive at low temperatures, a gate-on voltage VON having a relatively high voltage level is applied to the output transistor to compensate for such hypoactivity. Conversely, since the output transistors are hyperactive at high temperatures, a gate-on voltage VON having a relatively low voltage level is applied to the output transistor to compensate therefor. Accordingly, even though the operating characteristics of the output transistors may vary with display temperature, the gate driver 500 will nevertheless operate stably by the application thereto of a gate-on voltage VON that is inversely proportional to the display temperature, thereby improving the display quality of the display panel 100.

As illustrated in FIG. 2, the gate-off voltage generator 340 is connected to the driving voltage generator 310 to receive the first driving voltage AVDD1. The gate-off voltage generator 340 outputs the first driving voltage AVDD1 as a gate-off voltage VOFF after lowering the first driving voltage AVDD1 to the gate-off voltage VOFF. Since, as discussed above, the first driving voltage AVDD1 is maintained at a constant voltage level, the gate-off voltage VOFF from the gate-off voltage generator 340 is therefore also maintained at a constant voltage level.

The gamma voltage generator 350 is also connected to the driving voltage generator 310 to receive the first driving voltage AVDD1. The gamma voltage generator 350 outputs plural gamma voltages VGMMA, each which has a different voltage level that is disposed between the first driving voltage AVDD1 and a ground voltage. The gamma voltage generator 350 includes a resistor-string connected between the first driving voltage AVDD1 and the ground voltage, and outputs the gamma voltages VGMMA, of which the respective gray-scale levels thereof are determined by the resistor-string. The gamma voltages VGMMA are applied to the data driver 400 and used as a reference voltage when the image signal I-data is converted into the respective pixel voltages.

Figure 4:
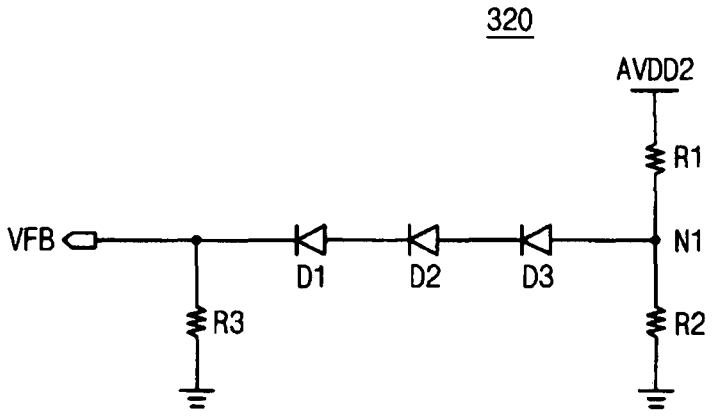
FIG. 4 is a circuit diagram of an exemplary embodiment of a temperature compensator of the exemplary voltage generating circuit of FIG. 2.
Figure 5:
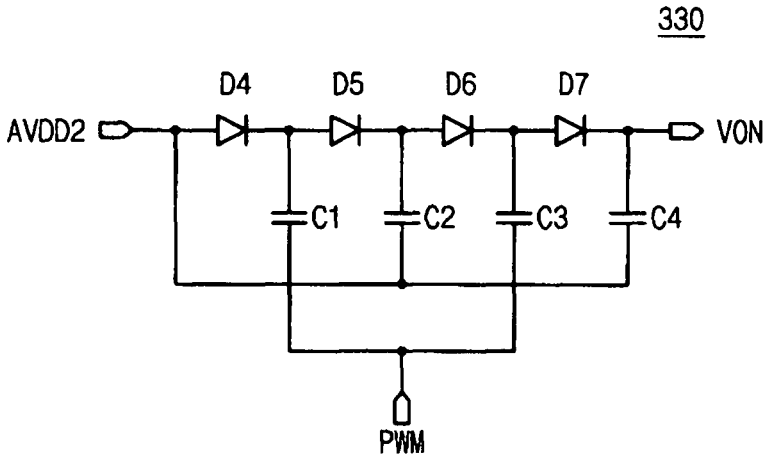
FIG. 5 is a circuit diagram of an exemplary embodiment of a gate-on voltage generator of the exemplary voltage generating circuit of FIG. 2.

FIG. 4 is a circuit diagram of an exemplary embodiment of the temperature compensator 320 of the exemplary voltage generating circuit 300 of FIG. 2, and FIG. 5 is a circuit diagram of an exemplary embodiment of the gate-on voltage generator 330 thereof.

Referring first to FIG. 4, the temperature compensator 320 includes a first diode D1, a second diode D2, a third diode D3, a first resistor R1, a second resistor R2 and a third resistor R3.

The first and second resistors R1 and R2 are connected in series between the second driving voltage AVDD2 and the ground voltage. In FIG. 4, a point of contact between the first and second resistors R1 and R2 is defined as a first node N1. The third resistor R3 is connected between a feedback terminal of the switching voltage generator 312 and the ground voltage.

The first to third diodes D1, D2 and D3 are reversely connected between the feedback terminal of the switching voltage generator 312 and the first node N1. The feedback voltage VFB has a voltage level obtained by subtracting a forward voltage VF of the first to third diodes D1, D2 and D3 from a voltage level at the first node N1. The forward voltage VF of the first to third diodes D1, D2 and D3 is inversely proportional to the temperature of the circuit. Thus, since the forward voltage VF of the first to third diodes D1, D2 and D3 decreases with increasing temperature, the feedback voltage VFB increases, and since the forward voltage VF of the first to third diodes D1, D2 and D3 increases with decreasing temperature, the feedback voltage VFB decreases.

In FIG. 4, the exemplary temperature compensator 320 is illustrated as having three diodes D1, D2 and D3, but it should be understood that the number of the diodes of the temperature compensator 320 may be varied. For example, when the number of the diodes of the temperature compensator 320 is increased, the temperature compensator 320 will generate a feedback voltage VFB that is more sensitive to the temperature variation.

Referring to FIG. 5, the gate-on voltage generator 330 includes a charge pump configured to have fourth through seventh diodes D4-D7, and first through fourth capacitors C1-C4. The fourth to seventh diodes D4-D7 are forwardly connected between the second driving voltage AVDD2 and an output terminal of the gate-on voltage generator 330.

The gate-on voltage generator 330 pumps the switching pulse voltage PWM a predetermined multiple number times with reference to the second driving voltage AVDD2 and outputs the pumped switching pulse voltage PWM as the gate-on voltage VON. Since the second driving voltage AVDD2 and the switching pulse voltage PWM applied to the gate-on voltage generator 330 are inversely proportional to the display temperature, the gate-on voltage VON is also inversely proportional to the display temperature.

Figure 6:
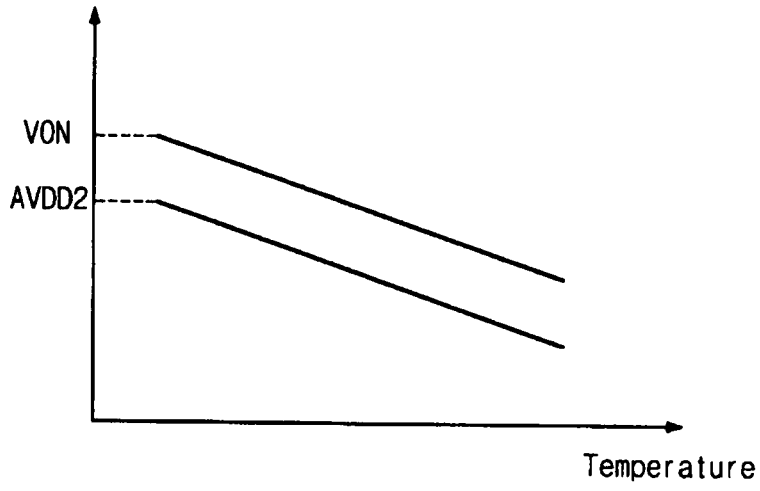
FIG. 6 is a graph of a gate-on voltage and a second driving voltage generated by the exemplary voltage generator of FIG. 2 as a function of display temperature.
Figure 7:
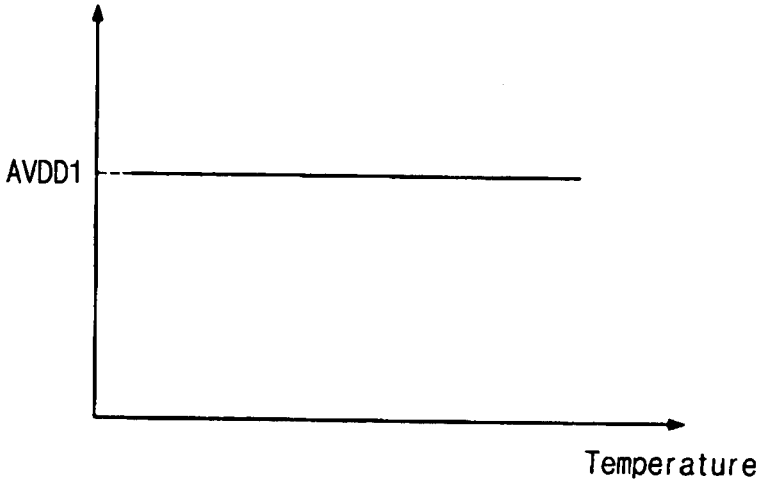
FIG. 7 is a graph illustrating a first driving voltage generated by the exemplary voltage generator of FIG. 2 as a function of display temperature; and, FIG. 8 is a plan view of the exemplary LCD of FIG. 1.

FIG. 6 is a graph of the gate-on voltage VON and the second driving voltage AVDD2 generated by the exemplary voltage generator 300 of FIG. 2 as a function of display temperature, and FIG. 7 is a graph illustrating the first driving voltage AVDD1 generated by the voltage generator as a function of display temperature.

Referring to FIG. 6, the switching pulse voltage PWM generated by the switching voltage generator 312 is inversely proportional to the display temperature due to the feedback voltage VFB fed back from the temperature compensator 330, as illustrated in FIG. 2. Thus, the second driving voltage AVDD2 obtained by rectifying the switching pulse voltage PWM is also inversely proportional to the display temperature.

Also, the gate-on voltage VON obtained by pumping the switching pulse voltage PWM a predetermined number of times with reference to the second driving voltage AVDD2 is inversely proportional to the display temperature.

However, as illustrated in FIG. 7, the first driving voltage AVDD1 is independently generated without relation to the temperature compensator 320, so that the first driving voltage AVDD1 is maintained at a constant level.

As described above, the first driving voltage AVDD1 is applied to the gamma voltage generator 350 and used as a reference for the gamma voltage VGMMA. Since the gamma voltage VGMMA is generated based on the first driving voltage AVDD1, the gamma voltage VGMMA is maintained at the initial state thereof. Consequently, the response speed of the liquid crystal layer of the display panel 100 is maintained constant without relation to the display temperature, thereby stabilizing the brightness characteristics of the display panel 100 and improving the product reliability of the LCD 600.

FIG. 8 is a plan view of the exemplary LCD 600 illustrated in the functional block diagram of FIG. 1. Referring to FIG. 8, the exemplary LCD 600 includes the display panel 100 on which the image is displayed, a printed circuit board 700 arranged adjacent to the display panel 100, and a plurality of tape carrier packages 800 that are electrically connected between the display panel 100 and the printed circuit board 700.

The display panel 100 includes an array substrate 110, a color filter substrate 120 facing the array substrate 110 and a liquid crystal layer (not illustrated) disposed between the array substrate 110 and the color filter substrate 120. The array substrate 110 is divided into a display area DA on which the image is displayed, and first and second peripheral areas PA1 and PA2 located adjacent to the display area DA.

The pixels are arranged in the display area DA of the array substrate 110 in a matrix configuration. The first peripheral area PA1 is situated adjacent to first ends of the gate lines GL1-GLn, and the gate driver 500 is arranged in the first peripheral area PA1 in order to sequentially apply the gate pulse to respective ones of the gate lines GL1-GLn.

As described above, the gate driver 500 is formed directly on the array substrate 110. More specifically, the gate driver 500 is formed directly on the array substrate 110 through the same thin film process used to form the pixels on the display panel 100.

The gate driver 500 includes the shift register described above in which the stages are connected to each other one after another in a ring-type arrangement. Output terminals of the stages are connected to the first ends of the gate lines GL1-GLn, respectively. Thus, the stages are turned on sequentially so as to sequentially apply the gate pulse to the gate lines GL1-GLn.

The second peripheral area PA2 is situated adjacent to first ends of the data lines DL1-DLm, and first ends of the tape carrier packages 800 are attached to the second peripheral area PA2. Second ends of the tape carrier packages 800 are attached to the printed circuit board 700. The data drivers 400 are provided in the form of a chip and are mounted on respective ones of the tape carrier package 800 in order to apply the pixel voltages to the data lines DL1-DLm.

The timing controller 200 and the voltage generating circuit 300 illustrated in FIG. 1 may both be mounted on the printed circuit board 700. In the exemplary embodiment of FIG. 8, the timing controller 200 and the temperature compensator 320 of the voltage generating circuit 300 are provided in the form of a single chip that is also mounted on the printed circuit board 700.

As illustrated in FIG. 8, the pixels are arranged on the array substrate 110 in a pixel structure that has a length in a first direction D1 that is less than its length in a second direction D2 substantially perpendicular to the first direction D1. In the particular pixel structure illustrated, each group of three adjacent pixels, such as red, green and blue color pixels, are sequentially arranged along the first direction D1 to define one pixel of a color image produced by the display.

In the particular exemplary embodiment of FIG. 8, the gate driver 500 is illustrated as being located adjacent to only the first ends of the gate lines GL1-GLn. However, in another possible embodiment (not illustrated), a second gate driver 500 may be disposed adjacent to opposite, second ends of the gate lines GL1-GLn. Also, the pixels arranged on the array substrate 110 may have a pixel structure in which the length in the first direction D1 is greater than the length in the second direction D2.

Further, although a gate driver 500 formed directly on the array substrate 110 through a thin film process has been described above and illustrated in FIG. 8, it should be understood that, in another possible embodiment, the gate driver 500 may be provided in the form of a single microchip mounted directly on the array substrate 110 or on a film (not illustrated) that is mounted on or otherwise attached to the array substrate 110.

According to the voltage generating circuit and the display apparatus of the present invention, the operating characteristics of the thin film transistors of the gate drivers vary in accordance with the temperature of the display, so that the gate-on voltage is generated based on a second driving voltage that is inversely proportional to that temperature. Thus, the gate driver operates stably in response to the modified gate-on voltage, thereby preventing any deterioration of the display quality of the display apparatus due to the effects of display temperature.

Additionally, the gamma voltages of the display are generated based on a first driving voltage that is maintained at a constant voltage level without relation to the temperature, thereby preventing any variation in the response speed of the display apparatus as a result of temperature variations. As a result, the product reliability of the display apparatus is improved.

As those of skill in this art will by now appreciate, many modifications, substitutions and variations can be made in and to the materials, methods and configurations of the LCD voltage generating circuits of the present invention without departing from its spirit and scope. Accordingly, the scope of this invention should not be limited to that of the particular embodiments illustrated and described herein, as they are only by way of some examples thereof, but instead, should be commensurate with that of the claims appended hereafter and their functional equivalents.

What is claimed is:

1. A voltage generating circuit providing a gate-on voltage and a gate-off voltage with a gate driver that includes an output transistor outputting a gate pulse in response to the gate-on voltage and the gate-off voltage to a corresponding gate line, the voltage generating circuit comprising:

a driving voltage generator that receives an external input voltage and outputs a first driving voltage and a second driving voltage, the first driving voltage being maintained at a constant level, the second driving voltage being varied in accordance with an external temperature in response to a feedback voltage;

a temperature compensator that receives the second driving voltage, generates the feedback voltage as a function of the external temperature and the second driving voltage, and applies the feedback voltage to the driving voltage generator;

a gate-off voltage generator that receives the first driving voltage and generates a gate-off voltage being maintained at constant levels independently of the external temperature; and a gate-on voltage generator that receives the second driving voltage and generates a gate-on voltage that is changed in response to the external temperature;

wherein the driving voltage generator comprises:

a first driving voltage generator that changes the external input voltage into the first driving voltage and outputs the first driving voltage;

a switching voltage generator receiving the external input voltage and the feedback voltage and outputting a switching pulse voltage having an amplitude that is varied in accordance with the feedback voltage; and a second driving voltage generator receiving the switching pulse voltage from the switching voltage generator and rectifying the switching pulse voltage to generate the second driving voltage.

2. The voltage generating circuit of claim 1, wherein the second driving voltage and the gate-on voltage decrease when the temperature increases, and the second driving voltage and the gate-on voltage increase when the temperature decreases.

3. The voltage generating circuit of claim 1, wherein the temperature compensator comprises at least one diode that varies the feedback voltage in accordance with variation of the external temperature.

4. The voltage generating circuit of claim 1, wherein the gate-on voltage decreases when the external temperature increases and the gate-on voltage increases when the external temperature decreases.

5. The voltage generating circuit of claim 1, wherein the gate-on voltage generator comprises a charge pump circuit that receives the second driving voltage and the switching pulse voltage to generate the gate-on voltage.

6. The voltage generating circuit of claim 1, further comprising a gamma voltage generator that receives the first driving voltage and generates a plurality of gamma voltages therefrom, each gamma voltage having a different voltage level that is disposed between the first driving voltage and a ground voltage.

7. A display apparatus, comprising:

a driving voltage generator that receives an external input voltage and outputs a first driving voltage and a second driving voltage, the first driving voltage being maintained at a constant level, the second driving voltage being varied in accordance with an external temperature in response to a feedback voltage;

a temperature compensator that receives the second driving voltage, generates the feedback voltage as a function of the second driving voltage and the external temperature, and applies the feedback voltage to the driving voltage generator;

a gate-off voltage generator that receives the first driving voltage and generates a gate-off voltage being maintained at constant levels independently of the external temperature;

a gate-on voltage generator that receives the second driving voltage and generates a gate-on voltage that is changed in response to the external temperature;

a gamma voltage generator receiving the first driving voltage and generating a plurality of gamma voltages therefrom, each gamma voltage having a different voltage level that is disposed between the first driving voltage and a ground voltage;

a gate driver that receives the gate-on voltage and the gate-off voltage and includes an output transistor outputting a gate pulse in response to the gate-on voltage and the gate-off voltage to a corresponding gate line;

a data driver changing an image signal into a pixel voltage based on the gamma voltages and outputting the pixel voltage; and a display panel charging the pixel voltage in a pixel in response to the gate pulse so as to display an image, wherein the driving voltage generator comprises:

a first driving voltage generator that changes the external input voltage into the first driving voltage and outputs the first driving voltage;

a switching voltage generator receiving the external input voltage and the feedback voltage and outputting a switching pulse voltage having an amplitude that is varied in accordance with the feedback voltage; and a second driving voltage generator receiving the switching pulse voltage from the switching voltage generator and rectifying the switching pulse voltage to generate the second driving voltage.

8. The display apparatus of claim 7, wherein the second driving voltage and the gate-on voltage are inversely proportional to the external temperature.

9. The display apparatus of claim 7, wherein the temperature compensator comprises at least one diode that varies the feedback voltage in accordance with variation of the external temperature.

10. The display apparatus of claim 7, wherein the display panel comprises:

a plurality of gate lines electrically connected to the gate driver to sequentially output the gate pulse;

a plurality of data lines electrically connected to the data driver to receive the pixel voltage, the data lines being insulated from and intersecting the gate lines;

a plurality of pixels arranged in pixel regions defined by the gate lines and the data lines, each of the pixels comprising:

a thin film transistor having a control electrode electrically connected to a corresponding gate line and an input electrode electrically connected to a corresponding data line; and, a liquid crystal capacitor electrically connected to an output electrode of the thin film transistor to receive the pixel voltage.

11. The display apparatus of claim 10, wherein the pixels and the gate driver are formed directly on the panel by a thin film process.

12. The display apparatus of claim 7, further comprising a timing controller that controls driving timings of the gate and data drivers and applies the image signal to the data driver in synchronization with the driving timings.

13. The display apparatus of claim 7, wherein the second driving voltage and the gate-on voltage are inversely proportional to the external temperature.

14. The display apparatus of claim 7, wherein gate-on voltage generator comprises a charge pump circuit that receives the second driving voltage and the switching pulse voltage to generate the gate-on voltage.

* * * * *